United States Patent [19]

Bagepalli

[11] Patent Number: 4,911,624

[45] Date of Patent: Mar. 27, 1990

[54] REDUCED FRICTION VANE DESIGN FOR ROTARY COMPRESSORS

[75] Inventor: Bharat S. Bagepalli, Schenectady, N.Y.

[73] Assignee: General Electric Company, Schenectady, N.Y.

[21] Appl. No.: 290,008

[22] Filed: Dec. 27, 1988

[51] Int. Cl.[4] ..... F01C 1/02

[52] U.S. Cl. ..... 418/92; 418/225

[58] Field of Search ..... 418/63, 75, 76, 91, 418/92, 153, 156, 225, 235

[56] References Cited

U.S. PATENT DOCUMENTS

| | | | |
|---|---|---|---|
| 3,450,108 | 6/1967 | Rich | 418/92 |
| 3,891,358 | 6/1975 | Ladusaw | 418/63 |
| 4,672,813 | 6/1987 | David | 418/92 |

FOREIGN PATENT DOCUMENTS

| | | | |
|---|---|---|---|
| 545067 | 2/1956 | Belgium | 418/92 |
| 250218 | 9/1926 | Italy | 418/225 |

OTHER PUBLICATIONS

Sano et al., 1984 International Compressor Engineering Conference, "Analysis of Hermetic Rolling Piston Type Compressor Noise, and Countermeasures", pp. 242–250, 1984.

*Primary Examiner*—Leonard E. Smith
*Assistant Examiner*—John A. Savio, III
*Attorney, Agent, or Firm*—Paul R. Webb, II; James C. Davis, Jr.

[57] ABSTRACT

An arrangement reduces friction between the sliding vane and rolling piston of a rotary compressor. In particular, a roller is built into a cavity at the tip of the vane. The roller provides rolling contact with the rolling piston so as to minimize friction between the vane tip and the rolling piston. An oil feed hole is provided in the cavity so as to feed oil onto the roller and, by way of the roller, to the external surface of the rolling piston. The reduction in friction reduces heat and, thereby reduces oil degradation. The result is less noise and less likelihood of mechanical breakdown.

17 Claims, 2 Drawing Sheets

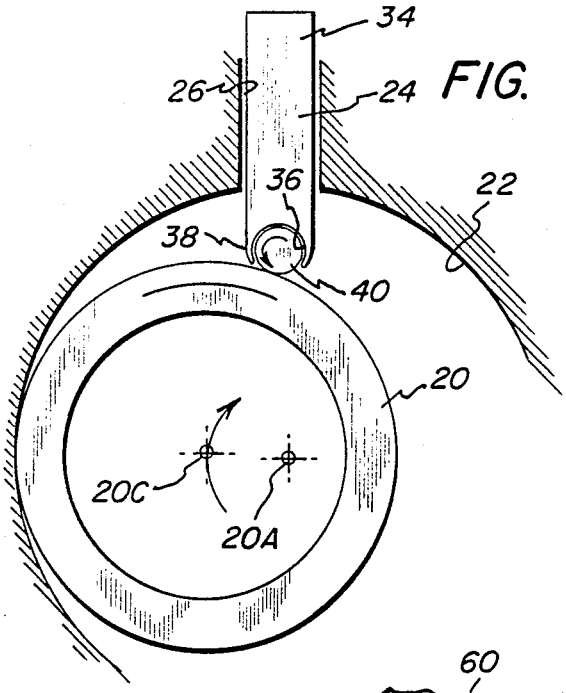
FIG. 2
FIG. 4
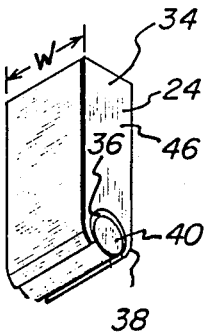
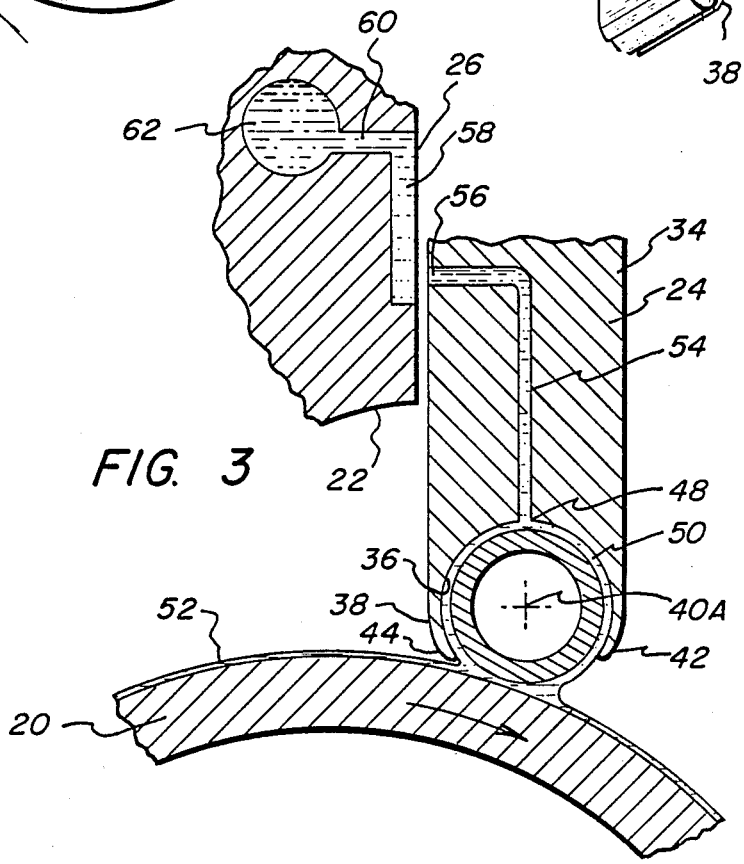
FIG. 3

REDUCED FRICTION VANE DESIGN FOR ROTARY COMPRESSORS

BACKGROUND OF THE INVENTION

The present invention relates to rotary compressors. More specifically, the present invention relates to a rotary compressor having a sliding vane which minimizes noise, and additionally, minimizes wear to the vane-roller interface due to improved lubrication.

A rotary type of compressor as commonly used for refrigerators and air conditioners often generates high frequency noise. Indeed, some refrigerators use rotary compressors which show a strong almost pure-tone noise of about 4 khZ.

Lubricant degradation caused by excessive heat generated at the vane-rolling piston contact occurs in such rotary compressors due to friction. This often results in a total loss of function and is a severe problem. The noise, friction, and lubrication problems are believed to be closely related.

Prior vane structures have tended to clump lubricant on one side of the vane, thereby causing an uneven distribution of lubricant. It should be noted that lubricant is often included in the refrigerant and is operable to coat various working surfaces of a rotary compressor.

Various methods of reducing rotary compressor noise have previously been considered.

One approach is to redesign the casing of the rotary compressor so as to reduce the sound radiation from it. The noise heard by the human ear results from the vibration of the casing which encloses the whole compressor structure. Modifying the sound radiation pattern is necessary for this approach. Theradiation can be modified by changing the bending rigidity of the compressor, i.e., changing the casing thickness or adding stiffness to the casing. However, redesigning the casing is relatively expensive and is therefore undesirable.

Another way of attenuating the compressor noise is by controlling the compressor gas spectrum. Any resonator type of device built into the discharge port works as a mechanical filter. This may adversely effect the compressor efficiency depending on the structure of the resonator.

Other attempts to reduce the high frequency noise have included changes in orifice design, clearances, and root radii. These changes have been only partially successful and are somewhat disadvantageous in that they often reduce the efficiency of the compressor.

Although the above approaches at noise reduction have been somewhat useful, there remains a need for significantly reducing the noise from a rotary compressor without reducing the efficiency of the compressor. Further, there is a somewhat related need to decrease friction and to avoid lubricant degradation.

OBJECTS AND SUMMARY OF THE INVENTION

Accordingly, it is a primary object of the present invention to provide a new and improved rotary compressor.

A more specific object of the present invention is to provide a rotary compressor having a noise reduction arrangement which is relatively easy and inexpensive to implement.

A further object of the present invention is to provide a rotary compressor which has reduced friction and, therefore, reduced lubricant degradation and reduced likelihood of mechanical breakdown.

Yet another object of the present invention is to provide a noise reduction arrangement for a rotary compressor which has little or no detrimental effect on the compressor efficiency.

The above and other objects of the present invention which will become more apparent as the description proceeds are realized by a rotary compressor having a cylindrical wall and a compression chamber within the cylindrical wall. A rolling piston is mounted for eccentric rotation about a rotation axis within the cylindrical wall. A vane is slidably mounted in a slot in the cylindrical wall, the vane having a tip bearing against the rolling piston.

Significantly, the tip of the vane includes a roller which bears against the rolling piston. The vane includes a main body separate from the roller and the main body is held offset from the rolling piston by the roller. The tip has a cavity and the roller is disposed in the cavity. The roller rotates about a roller axis parallel to the rotation axis. The tip has a width in the direction of the roller axis and the roller extends completely across the tip width. The cavity extends completely across the tip width. In one embodiment, the roller is hollow.

The structure of the vane of the present invention may alternately be described as including a main body with a cavity at the tip, the tip including a tip member separate from the main body and disposed in the cavity. The tip member bears against the rolling piston. The tip member is rotatable relative to the main body and is hollow. More specifically, the tip member may be a roller.

The vane structure of the present invention may alternately be described as having a vane which includes a lubricant feed hole at the tip for feeding lubricant to lubricate contact between the tip and the rolling piston. The lubricant feed hole is disposed in a cavity in which a tip member separate from a vane main body is disposed. The tip member may more specifically be described as a roller. Additionally, the tip member may more specifically be said to be hollow.

BRIEF DESCRIPTION OF THE DRAWINGS

The above and other features of the present invention which will become more apparent as the description proceeds are best understood by considering the following detailed description in conjunction with the accompanying drawings wherein like characters represent like parts throughout the several views and in which:

FIG. 2 is a sectional elevation view of a portion of the compressor of FIG. 1 illustrating a roller piston and vane according to one embodiment of the present invention;

FIG. 3 is a sectional elevation view similar to the view of FIG. 2 illustrating the roller piston and vane in more detail in accordance with a second embodiment;

FIG. 4 is an isometric view of the vane portion of the embodiment of FIG. 2;

DETAILED DESCRIPTION

Figure 1:
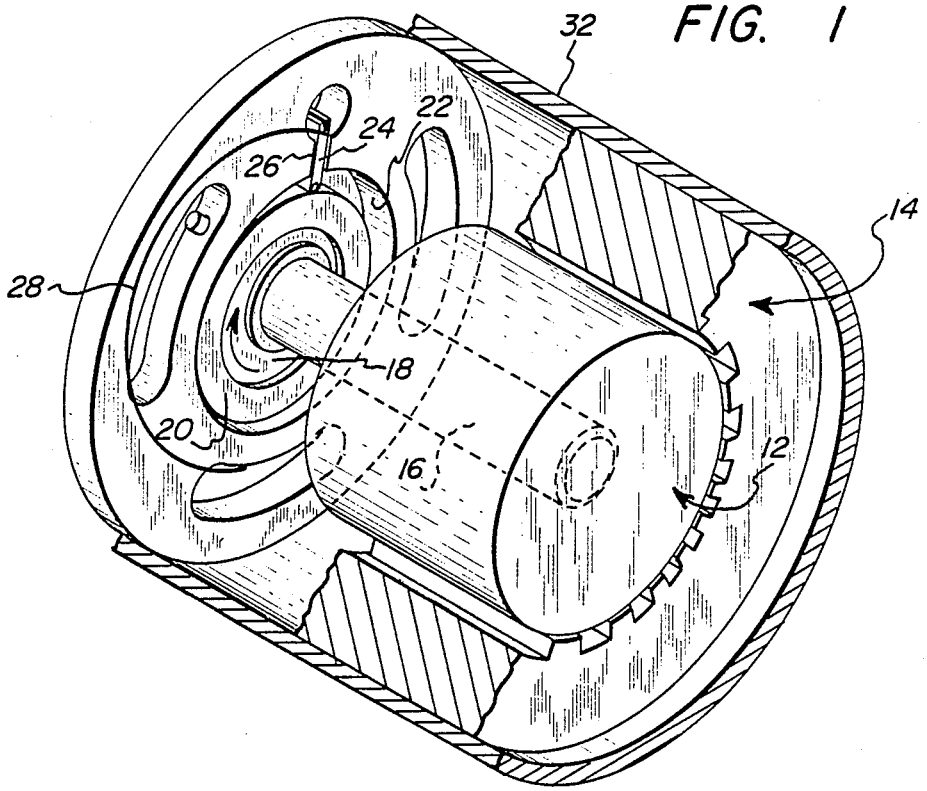
FIG. 1 is a simplified isometric view of a compressor in accordance with an embodiment of the present invention.

As shown in FIG. 1, the rotary compressor of the present invention includes a motor having rotor 12 and stator 14 which operate in known fashion to rotate a shaft 16. An eccentric 18 is attached to the shaft 16 and a roller or rolling piston 20 surrounds the eccentric 18. The rolling piston 20 rotates eccentrically relative to a cylindrical wall 22. A vane 24 is disposed in a slot 26 in the cylindrical wall 22. A spring 28 is used to bias the slidable vane 24 inwardly. A casing 32 surrounds the structure.

The general principles of operation of a rotary compressor are well known and the discussion which follows will emphasize unique features with respect to the vane structure.

With reference now to FIGS. 2, 3, and 4, the structure of vane 24 will be discussed in more detail. The vane 24 includes a main body 34 having a cavity 36 disposed therein. The cavity 36 is more specifically disposed at a tip 38 which bears against the roller 20 as the roller eccentrically rotates about rotation axis 20A (which rotation axis is perpendicular to the plane of view of FIG. 2). The roller or rolling piston 20 has a center 20C which is offset and parallel to the axis of rotation 20A.

In addition to the cavity 36, the tip 38 includes a roller 40 disposed in the cavity. More specifically, the roller 40 may be captured between portions 42 and 44 (FIG.3 only) which curve inwardly partially around the roller 40. As shown in FIG. 3 only, the roller 40 may be hollow. As shown in FIG. 4, the roller 40 and cavity 36 may extend completely across the width W of the vane 24. The roller 40 may be slid into the cavity 36 from one end of the vane 24, such as end 46 (labeled on FIG. 4 only). In operation, the end 46 and an opposite end would each be abutting an end plate (not shown), the end plates being disposed at opposite ends of the cylinder of which cylindrical wall 22 is a part.

As the rolling piston 20 rotates about rotation axis 20C (FIG. 2 only), the roller 40 at the tip 38 of vane 24 will rotate about axis 40A (FIG. 3 only), which axis is parallel to axis 20A.

Concentrating now on FIG. 3, an oil feed arrangement of the present invention will be discussed. Oil is fed out of an oil feed hole 48 into the cavity 36 in order to form a thin layer 50 of oil around roller 40, and further supply oil to a thin layer 52 of oil along the surface of rolling piston 20. The oil feed hole 48 is supplied by way of oil passage 54 which has an entrance port 56. The entrance port 56 is supplied oil by way of a groove 58 which is disposed in the wall of the slot 26. The groove 58 receives oil from passage 60 which is connected to oil chamber 62. The oil chamber 62 may be originally supplied with sufficient oil for the mechanism to last almost indefinitely, as only a very small amount of oil would be needed to maintain operation. In other words, the chamber 62 may be sealed and need not be resupplied oil during the lifetime of the machine. However, one could alternately provide for replenishment of the oil. The oil could be supplied to oil feed port 48 by way of a gravity feed arrangement, but other alternatives such as pumps might alternately be used.

Although the discussion herein will assume that oil is the lubricant, it should also be noted that other possible lubricants could be used. The drawing of FIG. 3 shows the oil chamber 62 as a cavity in the high pressure side of the slot 26. As an alternative, the oil chamber could be on the low pressure side of the slot 26 (i.e., to the right side of vane 24 in the views of FIG. 2 and FIG. 3).

The oil may be fed to cavity 36 by having two small enclosed passages such as 54 located adjacent opposite sides of the vane 24 or by having a single enclosed passage such as 54 centrally located widthwise in the vane. Alternately, more than two such passages 54 could be used or a single wide (extending significantly in the widthwise direction) passage could be used.

The operation of the compressor 10 follows the general operating principles of rotary compressors with the present invention reducing the friction and, therefore, reducing the lubricant degradation and the noise. In particular, instead of a tip fixed to the vane moving along the external surface of the rolling piston such as rolling piston 20, the present invention provides for a rolling contact between the roller 40 portion of the tip 38 and the piston 20. As shown in FIG. 2, the rolling piston 20 rotates clockwise, whereas the roller 40 rotates counter-clockwise. An important advantage of this rolling contact is that the friction is reduced and the heat is reduced such that there is less tendency to degrade the oil or other lubricant which is disposed on the rolling piston 20. Therefore, the oil film 52 will degrade more slowly than lubricant films previously used in such rotary compressors. The vane structure will provide improved lubrication for the contact between the tip 38 of vane 24 and the rolling piston 20 and better lubrication at the contact between the rolling piston 20 and the cylindrical wall 22.

Not only does the rolling contact between the roller 40 and the rolling piston 20 lessen the heat which might degrade the lubricant, but the rolling contact lessens the tendency of the tip of the vane to clump the lubricant on the high pressure side of the vane. In other words, unlike the previous vane arrangements which tended to cause lubricant to gather in a big clump on the high pressure side of the vane, the rotation of roller 40 tends to draw some of the lubricant from the high pressure side of the vane to the low pressure side of the vane. This tends to maintain a more even distribution of lubricant about the external surface of the rolling piston 20 such that contact between rolling piston 20 and the cylindrical surface 22 is better lubricated.

As mentioned previously, lubrication of rotary compressors has been accomplished by inclusion of lubricants in with the refrigerant fluids which are compressed by the compressor. The lubricants tend to coat the working surfaces of the various machine parts and to lessen friction. However, degradation of the oil or other lubricant was caused, among other reasons, by the friction generated by contact between the vane and the rolling piston. Additionally, the effectiveness of the lubrication was reduced by the tendency of the vane to cause the lubricant to remain on one side of the vane. The present arrangement which provides for rolling contact between the vane and the roller piston significantly reduces these problems such that the roller 40 might be used without the oil feed port or hole 48 and associated oil feed arrangement if desired. That is, one could use the roller 40 in conjunction with the usual lubrication arrangement relying upon lubricant in the refrigerant itself. However, the use of the oil feed hole 48 may provide better lubrication and, therefore, further reduce friction, lubricant degradation, and noise. If one uses the oil feed hole 48 and associated parts, the groove or channel 58 along the side wall of slot 35 should have a length corresponding to the stroke of the vane 24. In other words, the entrance port 56 should be in communication with the groove 58 when the vane 24 is at any position in its stroke.

By making the roller 40 hollow as shown in FIG. 3, the roller 40 will be more compliant and this will further help reduce noise. It should be noted that the roller 40 would be the only portion of the tip 38 of vane 24 which bears against the rolling piston 20. In other words, the main body 34 of vane 24 does not bear against the rolling piston 20.

Figure 5:
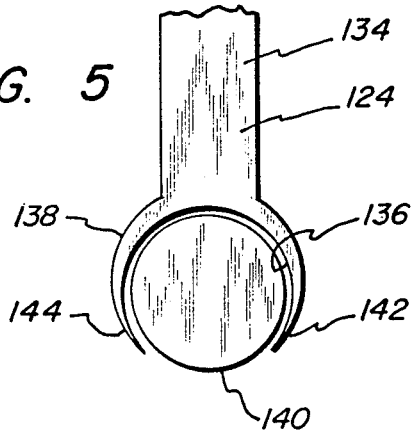
FIG. 5 is a sectional elevation view of the vane portion of the compressor of FIG. 1 in accordance with a third embodiment.

With reference now to FIG. 5, there is shown an alternate construction vane 124. The embodiment of FIG. 5 has components with numbers in the "100" series and with the same last two digits as the corresponding component in the embodiment of FIGS. 2–4. The vane 124 includes a main body 134 and has a tip 138 with a cavity 136 disposed therein. As shown, the portions 142 and 144 expand out around the roller 140 such that the roller 140 may have a diameter greater than the thickness of the portion of vane 124 which would slide within a slot (slot not shown) in the cylindrical wall (not shown). The outer surfaces of portions 142 and 144 could be alternately shaped (not shown) to have a mushroom like shape in a side view (i.e., like the view of FIG. 5).

The roller 140 could be hollow and the vane 124 could include an oil feed arrangement like that illustrated for the FIG. 3 design.

An advantageous feature of the present invention is that it would not perform any worse than the usual vane arrangement even upon failure. If the oil in cavity 62 was used up, the rolling contact between roller 40 and rolling piston 20 would still provide results superior to the usual vane tip design. Presumably, one would still use a portion of lubricant in the refrigerant so that some lubricant would still be supplied. If the system failed even further such that the roller 40 jammed in the cavity 36 and stopped rotating, the arrangement would essentially revert to the characteristics of the ordinary vane without any oil feed hole and any roller or rotating pin 40. Therefore, implementation of the present invention in order to reduce friction and thereby reduce lubricant degradation and noise would not increase the chances of a mechanical breakdown. Under a worst case failure, the invention assumes the characteristics of the usual vane design wherein the tip of the vane is simply a curved tip integral with the rest of the vane.

Although various specific constructions and arrangements have been described herein, it is to be understood that these are for illustrative purposes only. Various modifications and adaptations will be apparent to those of skill in the art. Accordingly, the scope of the present invention should be determined by reference to the claims appended hereto.

What is claimed is:

1. A rotary compressor comprising:
a cylindrical wall;
a compression chamber within said cylindrical wall;
a rolling piston mounted for eccentric rotation about a rotation axis within said cylindrical wall; and
a vane slidably mounted in a slot in said cylindrical wall, said vane having a tip bearing against said rolling piston, said tip including a hollow roller which bears against said rolling piston.

2. The rotary compressor of claim 1 wherein said vane includes a main body separate from said roller, and said main body is held offset from said rolling piston by said roller.

3. The rotary compressor of claim 1 wherein said tip has a cavity and said roller is disposed in said cavity.

4. The rotary compressor of claim 3 wherein said roller rotates about a roller axis parallel to said rotation axis, and said tip has a width in the direction of said roller axis, and said roller extends completely across said tip width.

5. The rotary compressor of claim 4 wherein said cavity extends completely across said tip width.

6. The rotary compressor of claim 4 further comprising a lubricant feed hole at said tip for feeding lubricant by way of said cavity to lubricate contact between said roller and said rolling piston.

7. The rotary compressor of claim 1 wherein said vane has a lubricant feed hole at said roller for feeding lubricant to lubricate contact between said tip and said rolling piston.

8. The rotary compressor of claim 1 wherein said vane has a lubricant feed hole at said roller for feeding lubricant to lubricate contact between said tip and said rolling piston.

9. A rotary compressor comprising:
a cylindrical wall;
a compression chamber within said cylindrical wall;
a rolling piston mounted for eccentric rotation about a rotation axis within said cylindrical wall; and
a vane slidably mounted in a slot in said cylindrical wall, said vane having a tip bearing against said rolling piston, said vane having a main body with a cavity at said tip, said tip including a hollow tip member separate from said main body and disposed in said cavity, and wherein said tip member bears against said rolling piston.

10. The rotary compressor of claim 9 wherein said tip member is rotatable relative to said main body.

11. The rotary compressor of claim 9 wherein said tip member is a roller.

12. The rotary compressor of claim 11 wherein said roller rotates about a roller axis parallel to said rotation axis, and said tip has a width in the direction of said roller axis, and said roller extends completely across said tip width.

13. The rotary compressor of claim 9 further comprising a lubricant feed hole at said tip for feeding lubricant by way of said cavity to lubricate contact between said tip and said rolling piston.

14. A rotary compressor comprising:
a cylindrical wall forming a compression chamber;
a rolling piston mounted for eccentric rotation about a rotation axis within said chamber; and
a vane slideably mounted in a slot in said cylindrical wall, said vane having a tip bearing against said rolling piston, said vane having a lubricant feed hole at said tip for feeding lubricant to lubricate the contact between said tip and said rolling piston, said vane having a main body with a cavity at said tip, said tip including a hollow tip member separate from said main body and disposed in said cavity, and wherein said tip member bears against said rolling piston.

15. The rotary compressor of claim 14 wherein said lubricant feed hole is disposed in fluid communication with said cavity to feed lubricant to said cavity.

16. The rotary compressor of claim 15 wherein said tip member is a roller.

17. The rotary compressor of claim 14 wherein said tip is so constructed so as to be relatively more compliant than a non-hollow tip member of the same material.

* * * * *